US005080272A

United States Patent [19]

Buschmann et al.

[11] Patent Number: 5,080,272

[45] Date of Patent: Jan. 14, 1992

[54] DEVICE FOR IMPROVED CONTROL IN THE TRANSPORT OF EDGE-PERFORATED PAPER WEBS IN PRINTERS

[75] Inventors: Ulrich Buschmann, Elchingen; Günter Gomoll, Nersingen/Leibi; Wolfgang Hauslaib, Langenau, all of Fed. Rep. of Germany

[73] Assignee: Mannesmann Aktiengesellschaft, Mannesmannufer, Fed. Rep. of Germany

[21] Appl. No.: 589,793

[22] Filed: Sep. 28, 1990

[30] Foreign Application Priority Data

Sep. 29, 1989 [DE] Fed. Rep. of Germany ..... 3933030

[51] Int. Cl.[5] ..... B65H 20/20

[52] U.S. Cl. ..... 226/74; 226/87; 226/86; 400/616.1; 400/616.3

[58] Field of Search ..... 226/74, 75, 82, 86, 226/87, 52, 59, 76; 400/616.1, 616.2, 616.3

[56] References Cited

U.S. PATENT DOCUMENTS 4,394,949 7/1983 Gomi ..... 226/82 X
4,619,389 10/1986 Isobe ..... 226/82 X
4,844,314 7/1989 Wilson, III ..... 226/74
4,867,591 9/1989 Unuma ..... 226/74 X
4,874,121 10/1989 Rubinshtein ..... 226/74

*Primary Examiner*—Daniel P. Stodola
*Assistant Examiner*—P. Bowen
*Attorney, Agent, or Firm*—Cohen, Pontani & Lieberman

[57] ABSTRACT

A device for the feeding or advancement of an edgeperforated paper web (1) in a dot-matrix printer or the like includes a pair of drive belts (3) transversely spaced apart proximate opposite transverse edges of the web, each belt carrying on its upper surface (6) a series of pins (7) for releasable engagement with the edge-disposed web perforations (11). To provide an increase in friction between the paper web (1) and the drive belts (3) during transport of the web, and thereby assure enhanced accuracy and precision in operatively advancing the web, a plurality of upstanding or outwardly-protruding projections (17, 17*a*, 17*b*, 17*c*) are defined on the upper belt surface (6). These projections are located at least in the flat sections (16) of the belt between adjacently or successively-disposed ones of the pins (7) and, in another form of the invention, additionally at and coincident with the locations of the pins (7) which interrupt the transversely-oriented projections.

17 Claims, 1 Drawing Sheet

DEVICE FOR IMPROVED CONTROL IN THE TRANSPORT OF EDGE-PERFORATED PAPER WEBS IN PRINTERS

FIELD OF THE INVENTION

The present invention relates to a device for the advancing or feeding of edge-perforated paper webs in printers, particularly dot-matrix printers.

BACKGROUND OF THE INVENTION

Various apparatus for the feeding or advancement of edgeperforated paper webs into or through printers, such for example as dot-matrix printers, are known in the art. In a commonly-employed arrangement, the feeding force is transmitted to the web by a drive belt that carries, on its outwardly-disposed surface brought into opposition with the web, a plurality of pins for engagement with the transverse edge-defined web perforations. These pins may advantageously be configured so as to have a diameter that gradually increases in the direction of the pin base. The inward or opposite surface of the belt is provided with a series of teeth that are engageable with corresponding tooth gaps or indentations in a rotatably driven wheel through which the belt is thereby driven by the wheel. The paper web, thus advancingly carried on the upper or outward face of the belt, is thereby stretched transverse to the axis of the diametrically-varying pin and/or is pressed transverse to the pin axis by a swingable tractor flap.

Such drive belts are often used in so-called tractors which, arranged in pairs proximate the perforated edge regions of so-called Leporello paper, enable relatively precise feeding of the paper web. Such precision requires, of course, accurate engagement of the pins of the drive belt with the edge perforations in the web. However, the use of these web perforations for accurate paper feeding is fully effective only where the pins, when disposed in the perforations, fill the perforations in their entirety—i.e. the pins have a maximum diameter at their bases that substantially corresponds to the perforation diameter. Nevertheless, here too there remain differences in the effectiveness of transmission of the web feeding force. It must be recognized that the forces imparted to the opposed edge strips of the Leporello paper must be transmitted simultaneously and in the same amount in order to avoid skewed feeding of the web. Furthermore, transmission of the feeding force is dependent on the overall frictional conditions between the belt and web since the paper, together with the perforated edge strips thereon, must during transport be moved first onto the pins and, then, off and away from them.

Drive belts of this type having pins at fixed spacings or distances apart along the upper side or face thereof and the aforementioned teeth on the lower side or face of the belt are disclosed, for example, in Federal Republic of Germany OS 36 14 981 and U.S. Pat. No. 4,130,230. Such belts are typically disposed in pairs which are spaced apart by the width of the paper web and are concurrently operated so as to provide uniform travel of the two tractors in which the belts are respectively located.

OBJECTS AND SUMMARY OF THE INVENTION

It is accordingly an object of the present invention to improve the frictional conditions between the drive belt and the edge-perforated paper so as to increase the accuracy and precision with which the paper web is fed into and through the printer. It is a further and specific object of the invention to do so by generally increasing the drive force transmitted to the web without relying solely on the engagement between the belt-carried pins and the edge-disposed web perforations.

This and other objects are attained, in accordance with the invention, by providing the flat surfaces present on the upper side or face of the drive belt with projections, at least in the region between adjacently-located ones of the pins along the drive belt, these projections being effective to increase the friction between the web and the drive belt. The increase in friction between the paper web and the belt occurs, at least, upon insertion of the pins into the perforations at a point in time at which each perforation has not yet fully reached or descended to the larger diameter base portion of the pin. The drive force imparted to the web is thereby significantly increased prior to full engagement of the pin and perforation.

Various arrangements for implementing the provision of projections on the drive belt are contemplated. The belt may, by way of example, be roughened—as during manufacture by injection molding or the like—on the appropriate surface of the belt, such as by providing the surface with grooves between which the projections are produced. Nubs, conical peaks, or hemispheres or the like can also be used to obtain the desired effect.

In one form of the invention the projections are developed as ridge-shaped protrusions elongated or extending transverse to the direction of belt movement. This embodiment defines the frictional surfaces by frictional forces which recur at equally spaced apart distances.

The increase in frictional forces between the web and drive belt can also be realized by forming projections which extend along substantially the full width of the belt and are located both between each two successively-disposed pins in the direction of belt movement as well as at the location of each pin. In this manner, some of these transversely-extending projections are interrupted by the belt-carried projections.

The projections may advantageously be sized to provide an appropriate increase in frictional forces. For example, for a drive belt thickness of about 0.3 mm, the projections may have a height of about 0.1 to 0.2 mm above the upper surface or face of the belt.

It is furthermore advantageously contemplated that the drive belt, the pins and projections on its upper side, and the teeth on its lower side be injection molded as a single, unitary element formed, again by way of example, of a plasticizable flexible plastic material.

Other objects and features of the present invention will become apparent from the following detailed description considered in conjunction with the accompanying drawings. It is to be understood, however, that the drawings are designed solely for purposes of illustration and not as a definition of the limits of the invention, for which reference should be made to the appended claims.

BRIEF DESCRIPTION OF THE DRAWINGS

In the drawings, wherein similar reference characters denote like elements throughout the several views.

DETAILED DESCRIPTION OF THE PREFERRED EMBODIMENTS

Figure 1:
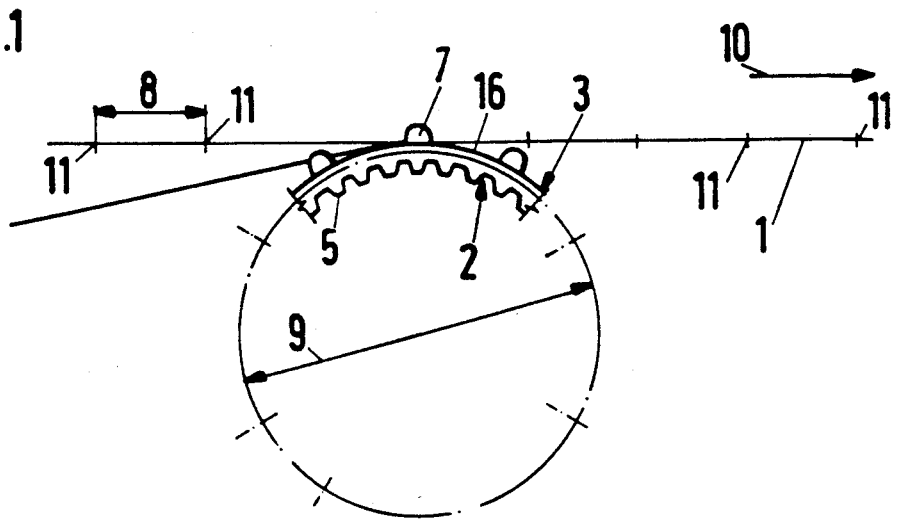
FIG. 1 is a full-scale, partly diagrammatic side view of the inventive drive belt resting on an operatively-rotatable driven wheel.

The inventive arrangement for the feeding or advancement of edge-perforated paper webs 1 in or through, for example, dotmatrix printers may be implemented in connection with a driven wheel 2, two such wheels 2 normally being disposed in spaced apart relation proximate the transversely-opposed, perforated edge regions of the paper web 1. The device is also equally well suited for use in connection with a pair of transversely spaced apart tractors, each tractor typically including a flap that can be swung or pivotted over and atop the respective perforated edge region of the paper web 1, in which case the driven wheel 2 and an associated idling wheel (not shown) in each tractor is wrapped by a flexible drive belt 3, as for example illustrated in FIG. 1, constructed in accordance with the invention.

Figure 2:
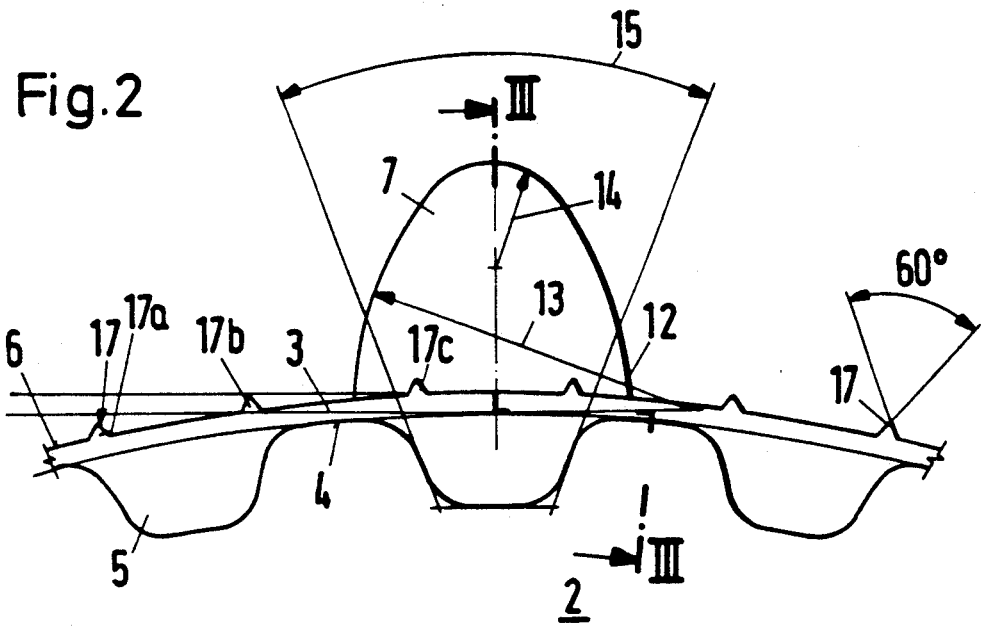
FIG. 2 is an enlarged view of a portion of FIG. 1, shown on a scale of approximately 10:1.
Figure 3:
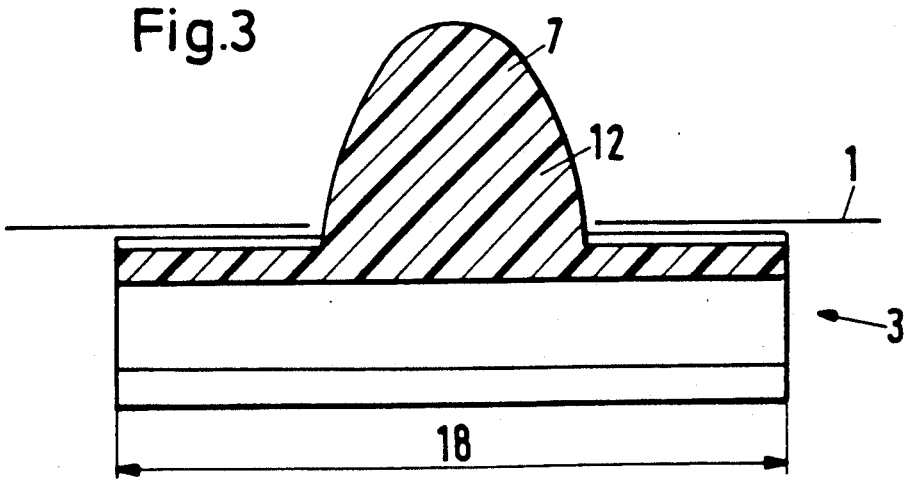
FIG. 3 is a cross-sectional view taken along the lines III—III in FIG. 2.

The lower side or surface or face 4 of the flexible drive belt 3 rests against the outer periphery of the wheel 2 and carries a series or plurality of teeth 5 for releasable mating engagement with corresponding tooth gaps defined on and along the periphery of the driven wheel. The opposite or upper side or surface or face 6 of the drive belt 3 carries a series or plurality of outwardlyprojecting pins 7 which are spaced one from the next along the belt at a distance or spacing 8. The distance 8 corresponds to the spacing between the adjacently-disposed ones of the perforations 11 defined in and along each transverse edge strip or region of the paper web 1. The drive belt 3 is designed, in this regard, on the basis of an effective diameter 9 (FIG. 1). The direction of movement 10 of the paper web 1 and drive belt 3 is also taken into consideration since each pin 7 comes into contact with and against the edge of a correspondingly-located web perforation 11, as the paper web advances, only in the direction of movement 10. Thus, the pin 7 and the perforation 11 have different diameters in that each pin 7, as seen in FIG. 2, has a diameter that varies along its axis—i.e. from its top or tip or free end to its bottom or base at which the pin depends from the upper surface 6 of the drive belt 3. More particularly, each pin 7 diametrically tapers inwardly as it axially extends from its base to its tip; thus, the pin base has a diameter (indicated by the radius 13 in FIG. 2) that is larger than the diameter (similarly indicated by the radius 14) of the pin top or tip or free end.

In order to obtain an accurately precise pitch, the belt teeth 5 are held to an angle 15 of about 40 degrees and are located, by way of example, in one-to-one correspondence and immediately below and aligned with the pins 7 (FIG. 2). A flat section 16, on which projections 17 are formed in accordance with the present invention, is defined between each two immediately-adjacent and successively-disposed pins 7 of the series or plurality of pins on the belt 3.

These projections 17 on the upper side 6 of the drive belt 3 may, as illustrated by way of example in the drawings, be implemented as projections 17*a* which extend along a direction transverse to the direction of movement 10—i.e. along the width of the belt.

Between each two of the pins 7 disposed successively along the direction of movement 10, the projections 17 may be formed as transverse projections 17*b* (FIG. 2) that extend in a continuous or uninterrupted manner across substantially the full width 18 of the belt 3. In addition, at the location of each pin 7 a similarly transverse projection 17*c* that is interrupted by the pin 7 may also be provided.

In practice, such a drive belt 3 constructed in accordance with the invention may have a thickness of about 0.3 mm and the projections 17, 17*a*, 17*b*, 17*c* may have a height of about 0.1 to 0.2 mm above the upper surface 6 of the drive belt.

Increased precision in the dimensions, shapes and tolerances of the elements of the invention may, advantageously, be attained by forming or fabricating the drive belt 3, the pins 7 on its upper surface 6, the teeth 5 on its lower surface 4 and the projections 17, 17*a*, 17*b*, 17*c* as a single, unitary piece or element using, by way of example, an injection molding process and a plasticizable flexible plastic material.

While there have been shown and described and pointed out fundamental novel features of the invention as applied to a preferred embodiment thereof, it will be understood that various omissions and substitutions and changes in the form and details of the device illustrated, and in its operation, may be made by those skilled in the art without departing from the spirit of the invention. It is the intention, therefore, to be limited only as indicated by the scope of the claims appended hereto.

What is claimed is:

1. Apparatus for advancing a web (1) along a transport direction (10), the web including a plurality of perforations (11) defined along the transport direction and proximate the opposed transverse edges of the web, said apparatus comprising:

a drive belt (3) movable along the transport direction (10) and carrying on a first surface (6) of the belt a plurality of outwardly projecting pins (7) for releasable engagement with the web perforations (11) for transmitting a moving force from the belt to the web (1) and thereby advancing the web along the transport direction, said belt carrying on a second surface (4) of the belt opposite said first surface (6) a plurality of teeth (5):

an operatively-rotatable driven wheel (2) having on its outer periphery a plurality of tooth gaps within which said belt teeth (5) are releasably engageable for effecting said movement of the drive belt along the transport direction with operative rotation of the driven wheel; and a plurality of outwardly-protruding projections (17) defined on said first surface (6) of the drive belt (3), at least one said projection being located in each flat section (16) defined between adjacently-disposed ones of said plural pins (7) for increased frictional contact of said drive belt (3) with the web (1) so as to enable enhanced control in the advancement of the web in the transport direction (10).

2. Apparatus in accordance with claim 1, wherein said first surface (6) comprises the upper surface of said drive belt (3) and said second surface (4) comprises the lower surface of said drive belt.

3. Apparatus in accordance with claim 1, wherein said projections (17) comprise ridge-shaped protrusions (17*a*) that extend substantially transverse to said transport direction (10).

4. Apparatus in accordance with claim 3, at least one said projection (17) being disposed at the location of each said pin (7) and being interrupted by the pin at said location.

5. Apparatus in accordance with claim 4, wherein said drive belt (3) has a thickness of approximately 0.3 mm, and said projections (17) have a height of approximately 0.1 to 0.2 mm above said first surface (6).

6. Apparatus in accordance with claim 5, wherein said drive belt (3), said pins (7), said teeth (5) and said projections (17) are unitarily fabricated as a single element formed of a flexible plastic material.

7. Apparatus in accordance with claim 4, wherein said drive belt (3), said pins (7), said teeth (5) and said projections (17) are unitarily fabricated as a single element formed of a flexible plastic material.

8. Apparatus in accordance with claim 3, wherein said drive belt (3) has a thickness of approximately 0.3 mm, and said projections (17) have a height of approximately 0.1 to 0.2 mm above said first surface (6).

9. Apparatus in accordance with claim 8, wherein said drive belt (3), said pins (7), said teeth (5) and said projections (17) are unitarily fabricated as a single element formed of a flexible plastic material.

10. Apparatus in accordance with claim 3, wherein said drive belt (3), said pins (7), said teeth (5) and said projections (17) are unitarily fabricated as a single element formed of a flexible plastic material.

11. Apparatus in accordance with claim 1, at least one said projection (17) being disposed at and extending across the location of each said pin (7) and being interrupted by the pin at said location.

12. Apparatus in accordance with claim 11, wherein said drive belt (3) has a thickness of approximately 0.3 mm, and said projections (17) have a height of approximately 0.1 to 0.2 mm above said first surface (6).

13. Apparatus in accordance with claim 12, wherein said drive belt (3), said pins (7), said teeth (5) and said projections (17) are unitarily fabricated as a single element formed of a flexible plastic material.

14. Apparatus in accordance with claim 11, wherein said drive belt (3), said pins (7), said teeth (5) and said projections (17) are unitarily fabricated as a single element formed of a flexible plastic material.

15. Apparatus in accordance with claim 1, wherein said drive belt (3) has a thickness of approximately 0.3 mm, and said projections (17) have a height of approximately 0.1 to 0.2 mm above said first surface (6).

16. Apparatus in accordance with claim 15, wherein said drive belt (3), said pins (7), said teeth (5) and said projections (17) are unitarily fabricated as a single element formed of a flexible plastic material.

17. Apparatus in accordance with claim 1, wherein said drive belt (3), said pins (7), said teeth (5) and said projections (17) are unitarily fabricated as a single element formed of a flexible plastic material.

* * * * *